US006829906B2

(12) United States Patent
Beam

(10) Patent No.: US 6,829,906 B2
(45) Date of Patent: Dec. 14, 2004

(54) MULTIPLE PRODUCTS AND MULTIPLE PRESSURE VAPOR RECOVERY SYSTEM

(76) Inventor: Craig A. Beam, c/o Propax Corporation 7723 Wycomb La., Houston, TX (US) 77070-3730

( * ) Notice: Subject to any disclaimer, the term of this patent is extended or adjusted under 35 U.S.C. 154(b) by 0 days.

(21) Appl. No.: 10/252,455

(22) Filed: Sep. 23, 2002

(65) Prior Publication Data

US 2003/0056535 A1 Mar. 27, 2003

Related U.S. Application Data

(60) Provisional application No. 60/325,458, filed on Sep. 27, 2001, and provisional application No. 60/324,030, filed on Sep. 21, 2001.

(51) Int. Cl.[7] ..... F25J 1/00

(52) U.S. Cl. ..... 62/613

(58) Field of Search ..... 62/48.2, 606, 613, 62/614

(56) References Cited

U.S. PATENT DOCUMENTS 4,727,723 A 3/1988 Durr
5,176,002 A * 1/1993 O'Brien et al. ..... 62/48.2

* cited by examiner

*Primary Examiner*—Denise L. Esquivel
*Assistant Examiner*—Malik N. Drake
(74) *Attorney, Agent, or Firm*—Mark R. Wisner

(57) ABSTRACT

Apparatus for recovering vapor during de-pressuring of a vessel, and for those facilities with such a need, for recovering vapor during the liquid filling, or liquid removing, from a vessel. In de-pressuring mode, the vapor and inert gas purging the vessel are processed to recover multiple product vapors with vapor pressures from as low as 0.1 PSIG to about 100 PSIG. Higher values up to 250 PSIG are also processed economically by an optional third-stage, stand-alone system. This system produces overall product recovery rates over 99% and inert gas recovery over 99% at the latter part of the cycle as recycle gas. The system is purged after each use to prevent cross contamination.

In the liquid filling mode, displaced vapor and pad gas (inert gas added to maintain pressure in tanks during liquid removing) are processed to recover multiple products and the pad gas. Since there is not a continuous flow of inert gas as during de-pressuring from which to extract a large refrigeration load, recovery rates may be lower. The product is returned to the vessel being filled or stored. The pad gas can be stored in a tank and re-used. Actual recovery rates are primarily a function of the actual vapor being displaced, the flow rate of filling, the amount of inert gas present and the type of inert gas. Economics of a particular application determine whether additional compression and/or heat exchangers are needed.

In the liquid removing mode, common practice is to release pressurized pad gas from a storage tank through appropriate valves and piping to return pad gas to the vessel compartment being unloaded. Vessel compartments have different pressure ratings and a pressure control system is installed to prevent over or under pressurizing the vessel. Addition of pad gas is normal practice and prevents pulling a vacuum on the vessel compartment and also increases the efficiency of the pump used for liquid removing by increasing head pressure.

15 Claims, 2 Drawing Sheets

94
FLARE
DETONATION ARRESTOR
96
WATER SEAL
92
U16
U3
91 VESSEL
EVAPORATOR
95
U2
NITROGEN STORAGE
90
U1
U5
U4
U10
U6
U12
U14
RECYCLE N2
U13
N2OUTLET
U8
U7
N2 INLET
TCV1
78
79
83
66
67
68
U15
PLANT INLET
U19
65C
DETONATION ARRESTOR
RECYCLE
113
65A
148
V144
V145
LOW PRESS FUEL
HIGH PRESS LIQUIDS
62
61
U17
U18
PIPING CONNECTIONS TO EXISTING SYSTEM
S

LOW PRESS FUEL
HIGH PRESS LIQUIDS
N2 INLET
TCU1
RECYCLE
CONDENSER
REF COMP
RECYCLE N2
N2 OUT
METHANOL
THIRD STAGE
2ND STAGE
1ST STAGE
OIL2
OIL1
INTERCOOL/ CONDENSER
AFTERCOOL
DET ARR
PLANT INLET

MULTIPLE PRODUCTS AND MULTIPLE PRESSURE VAPOR RECOVERY SYSTEM

This application claims benefit of Provisional application Ser. No. 60/324,030 filed Sep. 21, 2001 and claims benefit of Provisional application Ser. No. 60/325,458 filed Sep. 27, 2001.

BACKGROUND OF THE INVENTION

The present invention relates methods and apparatus for recovering volatile organic and inorganic compounds, including hazardous air pollutants, from vessels such as barges that need (1) vapor de-pressuring for changing products or for human entry for servicing and/or inspection, (2) liquid filling, or (3) liquid unloading. In more detail, the present invention relates to methods and apparatus for compressing, cooling, condensing, separating and storing volatile, and usually explosive, vapors with a product vapor pressure from below atmospheric pressure up to about 250 PSIG from the ullage of a vessel such as a barge during vapor de-pressuring, loading, or unloading of the vessel. The pressure of 250 PSIG was chosen for economic reasons as it includes valuable products with vapor pressures up to and including propane, propylene, and ammonia. In addition, the present invention strips the inert gas such as nitrogen from the product vapor to a high degree of purity and, by means of an automatic valve control system, recycles the inert gas that is recovered back to the vessel being serviced. This process greatly reduces the amount of expensive inert gas needed and can produce purity covered products.

Equipment is described in the patent literature, and a number of systems are currently in use, for the recovery of volatile hydrocarbons and chemical vapors released from the filling of tanks or barges with volatile liquids. For instance, U.S. Pat. No. 5,176,002 describes such a system that also recovers some of the inert gas by means of a column.

Previous attempts to recover hydrocarbon vapors displaced during the filling of storage tanks have utilized large condensation or absorption columns in combination with compressors and/or other apparatus to recover the hydrocarbon vapor as a liquid. Examples of such processes are disclosed in U.S. Pat. Nos. 3,967,938 and 4,10,091. A system for recovering and recycling pad gases discharged from marine vessels during loading is described in U.S. Pat. No. 5,524,456.

Another type of system for controlling hydrocarbon and other emissions during filling of storage tanks utilizes activated carbon or other solid adsorbent beds that selectively adsorb hydrocarbon vapors from the displaced vapor stream. The adsorbent bed is regenerated such as by a reduction in pressure to remove the hydrocarbon from the activated carbon. The hydrocarbon stream is then combusted or further processed in an absorption tower to recover a portion of the hydrocarbon as a liquid. An example of such a system is disclosed in U.S. Pat. No. 4,066,423.

A storage terminal vapor emission control system including an activated carbon absorption system and a plurality of vapor collection ducts connected in a way to effectively capture and control the vapors emitted is described in U.S. Pat. No. 4,995,890. Another system employing a vapor recovery system for loading racks and storage tanks that employs blanketing gas under controlled pressure conditions for admixture with vapor of the volatile liquid is represented. This mixture is processed for recovery of the vapor and gas constituents under the supervision of and control of precision oxygen monitoring. This system is described in U.S. Pat. No. 4,098,303.

However, on information and belief, no systems are known that perform all four of the following operations: 1) vapor de-pressuring, 2) liquid filling, 3) liquid unloading, and 4) inert gas recovery. It is therefore a primary object of the present invention to provide a method and apparatus for performing all four of these operations.

There are a number of factors that must be considered when a barge or other vessel is de-pressured for changing products or for such purposes as allowing human entry for servicing and/or inspection. In addition to the flammability of the vapors released from vessels that need to be entered, the creation of a breathable mixture of air must also be considered. It is recommended practice to have an expert monitor the lower explosive limit (LEL) of the vapors being purged and removed from barges and other vessels that need to be serviced before the hatches are opened. It is common practice to introduce an inert gas, most commonly nitrogen, into the vessel to be purged, such as a barge. The nitrogen can be introduced as a continuous purging flow of nitrogen where the barge discharge valve is open. Nitrogen can also be introduced as a batch flow where the barge pressure is increased, depending on the barge pressure rating, with the barge discharge valve closed. The barge pressure is then quickly released to help purge faster in a series of batch processes. A technician then makes precise lower explosive limit readings to determine when the barge has been sufficiently purged to enable the barge hatches to be opened to the air for servicing the barge without danger of explosion.

The common procedure for disposing of barge vapors prior to servicing the barge is to purge with nitrogen and pipe the vapors directly to a flare stack or to direct the vapor mixture to a low pressure vapor recovery system that mixes all recovered products. Vapors that are burned at the flare stack create no recovery value but, if not flared, these products are valuable if recovered as a pure liquid or as a mixture of liquids with a reasonably high BTU value for fuel. Many barge repair or inspection facilities receive barges with anywhere from 5 to 50 or more different hydrocarbon vapors or chemical vapors that need to be removed from the barges. These vapors will be either flammable hydrocarbons or harsh or hazardous chemical vapors. The vapor pressure of these barge products may vary from far below atmospheric pressure to over 250 PSIG vapor pressure. Many vapor recovery systems on the market today, such as rich oil-lean oil plants that are only designed to recover such products as benzene, alcohols and gasoline, do not operate above 5–10 PSIG vapor pressure. Products above that vapor pressure that are processed in such a system must be flared. High pressure, rich oil-lean oil plants are available, but are complex and expensive. Nitrogen is generally chosen as the inert gas used to purge vessels such as barges. Liquid nitrogen is relatively expensive but readily obtainable in sufficient purity (99.9% pure) to enable purging of the vessels to the 10% of lower explosive limit (LEL) purity required for human entry for welding operations. The LEL of propane, for example, is 2.0% propane in air. Nitrogen is difficult to recover in relative purity because of the cryogenic temperatures needed to separate it from the vapors being processed. In short, the design of such systems is almost always constrained by the specifics of each installation.

Many facilities must handle, or could benefit from handling, all four conditions listed earlier with a single, multi-purpose vapor recovery system. There is, therefore, a need for methods and apparatus that are adaptable for recovering a multitude of vapors from vessels to enable them to be de-pressured, filled or unloaded. There is a need for methods and apparatus that are safely used for moving vapors that are volatile, flammable, or hazardous from vessels that need to be processed. There is a need to recover the inert gas whenever economically possible. There is also a need to recover valuable vapors that are now being flared with absolutely no recovery. There is also a need to reduce facility-wide vented vapors that are commonly flared creating atmospheric byproducts, NOX, and noise and lighting nuisances.

SUMMARY OF THE INVENTION

These needs, and others known to those skilled in the art, are met by providing an apparatus for recovering vapors of a wide variety of vapor pressures from a vessel being de-pressured, filled or unloaded comprising a two-stage vapor compressor system with inlet separator, interstage cooler/condenser, after cooler, heat exchangers, oil separators, pumps, piping, storage tanks, dehydration system, lubrication system, automatic valve control system, control panel, and explosion proof electrical control system. The compressors, heat exchangers, and other components are designed to compress the specific vapor being processed to a specific storage tank pressure, to pump the condensed liquids to that specific storage tank, and to separate and recover a large part of the nitrogen and recycle it back to the vessel as a nearly pure nitrogen vapor.

In another aspect, the present invention provides a method of recovering vapor and the inert gas from the ullage of a vessel during operations such as de-pressuring or the loading and/or unloading of the vessel comprising the steps of:

(a) removing vapor from the ullage of the vessel;

(b) decreasing the temperature of the vapor to a temperature at which the liquids in the vapor condense by passing the vapor through a heat exchanger cooled by an inert expandable gas;

(c) separating the condensed liquids from the cold stream of vapor; and (d) utilizing the stream of cold vapor from which the condensed liquids have been separated in step (c) to decrease the temperature of the vapor between steps (a) and (b).

In this manner, the vapors are recovered in sufficient purity to have value as, for instance, fuel and/or for subsequent re-use.

DETAILED DESCRIPTION OF THE PREFERRED EMBODIMENTS

Figures 1, 2:
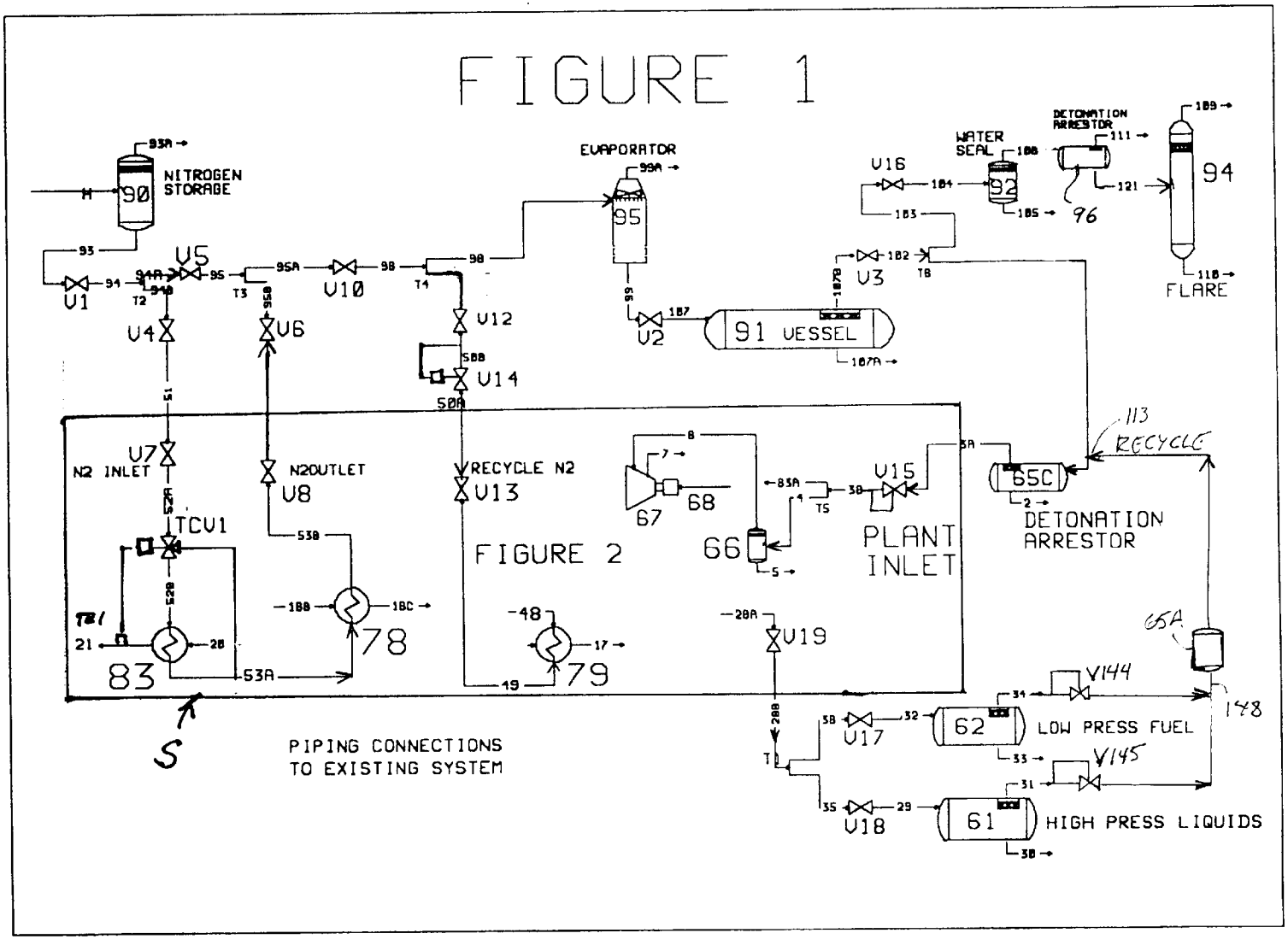
FIG. 1 is a schematic diagram of the piping connections needed to connect a presently preferred embodiment of an apparatus constructed in accordance with the teachings of the present invention to a typical existing barge vapor flaring system without a vapor recovery system.
FIG. 2 is a schematic diagram of a preferred embodiment of a combination vapor recovery system and nitrogen recovery system constructed in accordance with the teachings of the present invention.
Figure 2:
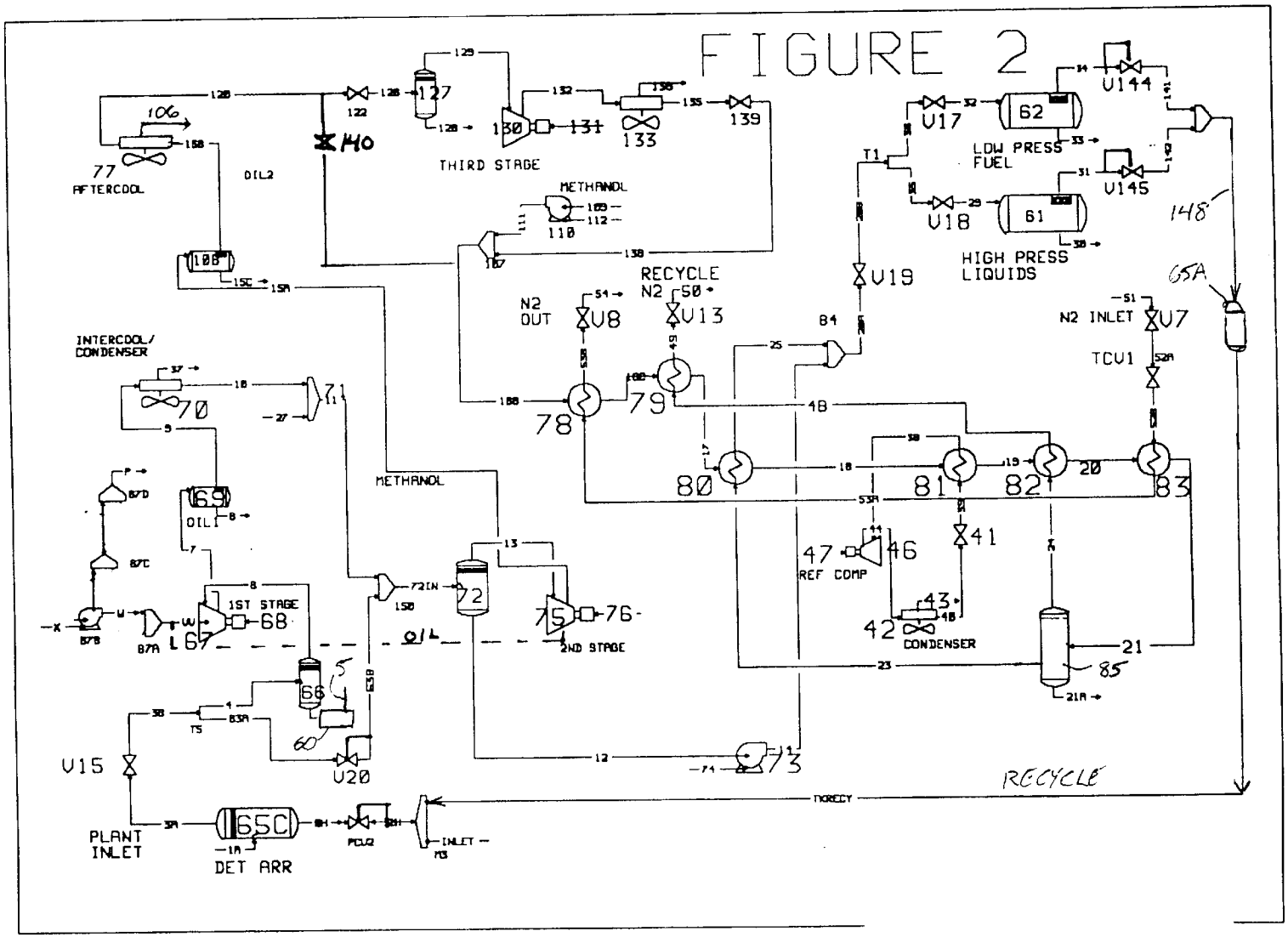

Barge vapor servicing and vapor de-pressuring facilities typically include storage tanks, pumps, pipes, valves, fittings, compressors, separators, nitrogen liquid storage tank, nitrogen evaporator, water seal vessel and flare system. Several components of a typical such facility are shown in FIG. 1. The present invention is designed to interconnect with this on-site equipment to facilitate vapor recovery and nitrogen recovery of the vessel from which the vapor is being removed.

Referring to FIG. 2, a preferred embodiment of a system constructed in accordance with the teachings of the present invention is shown schematically. The system is comprised of several systems including a two-stage compressor, complete refrigeration system, heat exchanger system, cold product separator and separator-pump system, tank system, lubricant system, dehydration system, control system, and nitrogen (one skilled in the art will recognize that carbon dioxide or other inert gases can also be used) recycle pressure valve control system, preferably all mounted on a single skid S.

These components are combined in an apparatus such as the one shown in FIG. 2 for recovering purity vapors from a barge and for recovering sufficient purity nitrogen for recycling. Vessel vapor and nitrogen flow through detonation arrestor 65C which protects vessel 91 from a flame backflow, on to the opened inlet pressure control valve V15. Pressure control valve V15 modulates the incoming flow of pressure from vessel 91 vapors to about 1 to 5 PSIG. Typical incoming pressures vary widely, such as when encountering batch processing and higher pressure products, both of which are discussed below. The vapors flow from V15 and then into the skid inlet separator 66. The inlet separator 66 collects liquids that could cause damage to the first stage compressor 67. Liquids accumulating in inlet separator 66 would be rare and are removed through the blowcase system, shown schematically at reference numeral 60, connected to separator 66 by line 5. The blowcase system 60 is purchased as a system from such vendors as A. G. Equipment Co. (Broken Arrow, Okla.) for occasional removal of liquids from a separator or full-time vacuum service and is comprised of two compartments with automated flow diverter valves and level transmitters and operates by valving one compartment open to separator 66 to collect liquids while the other compartment is valved off, pressurized, and dumped. Liquids from separator 66 are normally piped to an existing waste disposal system. If a higher pressure discharge condition is needed for disposal, a pump is added to pressurize the liquids to a high pressure waste recovery system. Dry vapors from separator 66 connect to the first stage compressor 67 which is driven by explosion proof motor 68. Motor 68 can be a variable speed drive type, but that feature is generally not beneficial in this type of system where constant throughput is matched to the nitrogen flow. An example of a suitable compressor for use as the compressor 67 is an A-C Compressor (Division of General Electric, Appleton, Wis.) rotary vane compressor with a double seal and steel casing construction. This particular compressor is one of the few that is designed to compress nearly any hydrocarbon or chemical vapor. Those skilled in the art who have the benefit of this disclosure will recognize that other compressors may also be used to advantage in this application, but will require of a blower fan with a detonation arrestor.

An adjustable pump lubrication system is provided that adjusts to accommodate the specific product vapor being compressed with respect to its specific lubrication need. Referring now to FIG. 2, the lubricant injection system comprises an adjustable flow pump lubrication system 67A driven by variable speed motor 67B, the speed of which is controlled by the operator by pre-selecting a number on a dial face 67C on control panel 67D. The selected number corresponds to a table of values for each product being compressed in the system in order to deliver the specific amounts of lubricant required to match the vapor being compressed. The lubricant rate required is in accordance with the compressor manufacturer's published specifications. Base-mounted motor coupling and lubrication pump and distribution systems of a type suitable for use in connection with the present invention are available from, for instance, Progress Equipment Co. (Houston, Tex.). The speed of motor 67B is therefore varied in accordance with the dilution factor of the product vapor being processed. There are some products such as gasoline that tend to act as solvents which readily dilute the compressor lubricant, requiring 3 to 4 times the normal rate of lubricant injection compared to relatively non-solvent products like glycols. Those skilled in the art who have the benefit of this disclosure will recognize that the speed of motor 67B can also be varied using a computer input of the product being processed rather than a manually-operated dial 67C. Those skilled in the art will also recognize that a dry screw compressor (such as is also available from A-C Compressor), although of great additional expense and complexity, may be utilized in place of the rotary vane compressor 67 and variably adjusted lubrication pump and distribution system.

Compressor 67 connects to the oil separator 69. This horizontal separator 69 is provided with coalescer elements designed to remove oil down to 1 to 5 microns. The liquid product recovered from this separator 69 will meet purity specifications of propane, propylene or other products when pumped to a clean dedicated tank. Oil separator 69 is connected to an air-cooled intercooler 70 that is driven by an explosion proof motor 37. Intercooler 70 is sized to also handle the air-cooled condensing load of such product vapors that condense immediately when compressed by compressor 67. The suction pressure of compressor 67 is normally about 1 PSIG or it may be up to 30 PSIG per PCV1 if the batch process of purging is used or recycled gas is returning from the tanks by line 148 as discussed below. The discharge pressure of compressor 67 varies from about 5 PSIG to about 50 PSIG depending on the storage pressure of the product being compressed. Vapors and liquids from intercooler 70 are piped to separator 72. A float valve mounted on separator 72 senses the liquid level collecting in separator 72. Liquid pump 73 and its explosion-proof motor 74 are connected to separator 72. Pump motor 74 is switched on/off by the float valve on separator 72. The discharge pressure of pump 73 is varied from about 10 PSIG to about 100 PSIG as needed to overcome the upper discharge pressure of the second stage compressor 75 in order to push liquids directly into the tank that is selected.

For higher pressure products such as propane, propene, and ammonia, a higher compressor discharge pressure, up to 400 PSIG, is needed to economically produce purity product without overdriving the refrigeration system. Because these products are not polymer-forming or corrosive, many standard compressors can be used in such systems. The need for two or three compressors depends on the type of compressor chosen as will be recognized by those skilled in the art. Another novel feature of the apparatus of the present invention is that the refrigeration system, compression system, and heat exchanger system are designed to allow a doubling of capacity for the above-listed products with minimal additional system cost. This optional higher pressure system is shown in FIG. 2 and is comprised of inlet separator 127, compressor 130, motor 131, and aftercooler 133, and is isolated by valves 122 and 139.

Returning now to the interstage separator 72, the vapor leaving separator 72 enters the suction of the second stage compressor 75 driven by explosion proof motor 76. The lubricant system 67A, 67B, 67C, and 67D described above is also used to deliver lubricant to compressor 75. A distribution block is provided at each of the compressors 67 and 75 to accommodate the change in lubrication points from one compressor to the other. The discharge pressure of compressor 75 will vary from about 10 PSIG to about 100 PSIG also depending on the storage pressure of the vapor being compressed. The hot compressed vapors from compressor 75 enter the oil separator 108, which is also equipped with coalescer elements for oil removal. From the oil separator 108 the vapors flow to the air-cooled aftercooler 77 with explosion proof fan motor 106. The aftercooler 77 is preferably sized to deliver a product temperature within a 15° F. or 20° F. approach of the ambient temperature. Therefore the cooler discharge temperature typically varies from about 60° F. to about 120° F. Those skilled in the art who have the benefit of this disclosure will recognize that product temperatures are not limited to this range.

Referring now to systems for use with products having a vapor pressure below 100 PSIG, vapors leaving aftercooler 77 enter the first heat exchanger 78. The product vapors are cooled by the cold nitrogen vapors that left the heat exchanger 83. Exchanger 78 extracts the remaining chilling power from the cold nitrogen before sending it on to the normal piping leading to the evaporator 95 in FIG. 1. The vapors flow to exchanger 79 (FIG. 2) and are cooled by the cold vapors that originated at the cold separator 85 and then flowed through exchanger 82. The cooled vapors from exchanger 79 travel to exchanger 80 where they are further cooled by the chilled liquids leaving cold separator 85. The cool vapors from exchanger 80 flow to exchanger 81, where they are further cooled by an ammonia or equivalent refrigeration system. Separator 85 is a three-phase separator, liquids dropping out through line 23 and passing through heat exchanger 80 and line 25 to join the line 14 to tanks 61 and 62 at junction 84 and vapors exiting through line 24, heat exchanger 82, line 48, heat exchanger 79, line 49, valve V13, and line 50 to rejoin the line 98 from the nitrogen source 90, preferably before evaporator 95.

A novel aspect of the refrigeration system is that it is designed to supplement the reduction in temperature of the gases output from separator 66 effected by expansion of the inert gas through heat exchanger 83 before the inert gas is used to purge the ullage of vessel 91, thereby limiting the capacity of the refrigeration system so that only the refrigeration load needed when considering the refrigeration load provided by the nitrogen flow at exchanger 83. The refrigeration heat exchanger 81 is designed to handle the highest of all refrigeration loads expected from the most difficult product vapor and its full range of load versus descending temperature as the vapor temperatures drop during the cycle. The vapors leave exchanger 81 and flow to exchanger 82, which is cooled by the chilled vapors from cold separator 85, which will normally be at about minus 50° F. if nitrogen is the inert gas.

Another novel feature of the apparatus of the present invention is that each of the six heat exchangers is sized for its particular greatest heat transfer load at any time of depressurizing from 100% vapor with 0% nitrogen to about 1% vapor and 99% nitrogen and for the most difficult product vapor load it could ever experience. This comprehensive design was made possible by simulating the various product vapors to be experienced at all levels of vapor pressure products to be experienced with HYSIM™ software (Hyprotech International CO. (Houston, Tex.), a process simulator.

Vapors from heat exchanger 82 flow to exchanger 83, which is super-chilled by the approximately −320° F. nitrogen released from the nitrogen liquid storage tank from valves V4 (FIG. 1) and expanded across valve V7 by the steps and apparatus that follow. As noted above, nitrogen is the preferred inert gas; referring to FIG. 1, nitrogen from the storage vessel 90 is routed through valve V1 and blocked at valve V5 to force the flow through valve V4 located proximate to storage vessel 90. The line 15 leads from valve V4 to the location of the skid S and valve V7 on the skid S. Valve V7 is designed to allow expansion of nitrogen from normal storage pressure of about 250 PSIG to the normal operating pressure of 5 to 50 PSIG depending upon the purge process being used and is therefore selected to operate at −320° F. and is insulated (as is subsequent piping) to minimize chill loss and to minimize ice formation on the piping and melting water hazards.

Temperature control valve TCV1 (FIG. 1) is a three-way temperature control valve sensing the output temperature of the chilled vapor in line 21 from heat exchanger 83 by means of temperature element TE1. Suitable temperature control valves for use in connection with the present invention are available from such vendors as Fisher Bauman Valve Co. (Houston, Tex.). TE1 is typically a temperature sensor immersed in the product stream and protected by a thermal well inserted into a threaded connection (not shown) in line 21 and that inputs temperature data into TCV1 typically by means of capillary pressure or electrical signal. The operator selects the required chill temperature to meet purity specifications of Reid vapor pressure of the product in the dedicated tank 61 such as propane (according to the particular product) by referring to a multiple product operating guide that provides set points for temperature control valve TCV1. A typical operating temperature to achieve sufficient product separation would be −50° F. for a large number of products, depending also on the optional compressor discharge pressure selected. Concurrently, that temperature enables nitrogen to be recovered in sufficient purity to allow the nitrogen to be recycled for deep purging to obtain 0.1% of LEL in vessel 91.

As the vapor travels through exchangers 78, 79, 80, 81, 82, and 83, it is substantially condensed and in most cases drastically sub-cooled to a cold separator 85 inlet temperature of −50° F. down to −100° F., or even colder if greater nitrogen recycle purity is needed. Those skilled in the art will recognize that more or fewer heat exchangers could be used in this process of cooling the product stream. However, the number and arrangement of the exchangers 78, 79, 80, 81, and 82 feeding into exchanger 83 provide sufficient pre-chilling of the multitude of products represented and the multitude of nitrogen dilutions experienced in the process (from total purity to almost total dilution) that exchanger 83 is able to complete the chilling process to the set point temperature with the nitrogen flow rate available at any point in the purge process. Another reason for using six exchangers is to minimize the size and cost of the refrigeration subsystem needed at the refrigeration loop, the refrigeration loop being comprised of refrigerant compressor 47, motor 46, exchanger 81, thermal expansion valve 41, condenser 42, and condenser motor 43. Those skilled in the art will recognize that installations in which the amount of nitrogen that is available is limited and/or unavailable will require the use of a larger refrigeration subsystem and/or optional higher product vapor condensing pressures, which lower condensing pressures. The liquids condensed from the product flow leave exchanger 83 in line 21 and mix with the pumped liquid from pump 73 at junction 84 and enter cold separator 85.

The liquids from cold separator 85 flow through exchanger 80 and mix with the liquids pumped from pump 73 and are piped to the tank selected. Those skilled in the art will realize that any number of dedicated or mixed product tanks that need to be provided is based on the specifics of the application It is important to understand that as the vessel discharge valve V3 in FIG. 1 is opened and inlet valve V15 to the plant is opened, pure product vapors are received. As the nitrogen continues to enter and to push vapors from the vessel 91, the product vapors are continually increasing in nitrogen composition. The percent of nitrogen in the product vapor will gradually change from 0% to as high as 99.8% nitrogen. The present invention is designed to accommodate this radical change and to profit from it. In FIG. 2, for example, pure products with a vapor pressure of less than 100 pounds PSIG are compressed at the first stage compressor 67, condensed in the intercooler 70 at an ambient temperature of about 80° F., flow to the separator 72 and on to pump 73 and into the cold separator 85, through heat exchanger 80, separator 86, pump 87, and into its product storage tank 62. However, as the concentration of nitrogen increases, the condensing temperature is increased steadily to where at about 50% nitrogen concentration only about one half of the liquids will condense in separator 72 at the same temperature as before when the vapor was pure. These uncondensed 50% nitrogen and some product vapors then leave separator 72 and are further compressed at compressor 75 and re-cooled at the aftercooler 77. The vapor is air cooled to about 100° F. and flows through heat exchangers 79, 80, 81, 82, and 83 and into cold separator 85 at a set point temperature of about −50° F. The balance of the liquids falling out in separator 85 flow to exchanger 80 on the tube side and mix with the liquids pumped from the pump 73 at junction 84 and are piped to the tank selected.

One of the features of the present invention is that the −320° F. temperature of the nitrogen from the nitrogen storage tank 90 in FIG. 1, when released through V7 to exchanger 83, is utilized in heat exchanger 83 to chill product at no additional cost of nitrogen. On information and belief, the current common practice is to flow the liquid nitrogen through an evaporator 95 to drive ambient heat through a series of pipe fins to warm the nitrogen before it enters vessel 91 for the purpose of preventing condensation of the vapors in the vessel 91 which need to be vaporized for their complete removal. Rather than wasting the refrigeration capacity of the nitrogen, the present invention utilizes the chilling effect of the nitrogen to reduce the temperature of the gases output from separator 66 while raising the temperature of the nitrogen. As a result of this design, the present invention is able to recover very low vapor pressure products such as glycol vapor as well as very high vapor pressure products like propane and propene at up to 250 PSIG.

Those skilled in the art who have the benefit of this disclosure will also recognize the opportunity to offset the cost of refrigeration whenever economical with an increase in vapor pressure through additional compression, which lowers the condensing pressure, thereby lowering refrigeration loads and costs. Common higher-pressure products that can be recovered in this manner include propane, propylene, and ammonia. A novel feature of this invention is that the two-stage system plant described is specifically designed to include an optional third-stage of compression for recovery of such products as follows:

1. The heat exchangers are designed to accommodate the working pressure of the third stage system that will bring the vapor discharge pressure to about 350 to 400 PSIG.
2. The two-stage heat exchangers are designed with sufficient surface area to process either high pressure or low-pressure vapors economically.
3. The third stage system is designed to be added easily at a later date as a stand-alone packed system as the product mix at a facility would need to include high pressure products.
4. The two-stage refrigeration system is designed to so that it will process the higher-pressure products without additional refrigeration being needed.
5. The third-stage compressor system is manually valved off so it is only operated when there is a need to process high-pressure products.
6. Because the third-stage system compressor is isolated from having to process the low pressure products, it does not need to contend with lubrication restrictions, corrosive hazards or polymer buildup hazards.
7. The third-stage compressor therefore can be a standard, economical reciprocating type or flooded oil type screw compressor.

8. The free flow (no nitrogen vapor pushing it) of high pressure propane vapors at up to 250 PSIG can be processed with this system because the cooler-condenser is designed to condense all of the pure high pressure products at a temperature obtainable by air cooling only.
9. The third-stage system differs is similar to the first and second-stage system in that it is composed of an inlet separator 127, compressor 150, oil coalescer separator 108, and air cooled aftercooler 133. It differs in that no special lubrication system is needed and that the air cooler has the design capacity to function as a higher duty condenser.

As noted above, this optional third stage higher pressure system is isolated by valves 122 and 139, valve 140 being provided in the line 120 to close off the line 188 to heat exchanger 78.

To assist the operator in determining the concentration of product in the barge at any time and its relationship to the upper or lower explosive limit, a Teledyne Model 3020M Total Hydrocarbon Analyzer HCA 150 or its equivalent is utilized. The operator can make appropriate adjustments to the process temperature in separator 85 to increase or decrease the nitrogen purity being recycled.

Those skilled in the art will recognize from this disclosure that there are many systems that are used to advantage for dehydration. One system is a dual defrost system whereby one set of exchangers is purposefully allowed to coat up with ice. The other set is then exposed to the wet vapors and the first set is defrosted and the cycle repeats. Another system utilizes dryer beds. The method that is preferred for primarily dry vapors, and that is illustrated in the embodiment shown in the figures, is a methanol pump system. The methanol pump 110 (FIG. 2) pumps methanol supplied by pipe 109 from a methanol off-skid atmospheric liquid tank. The pumps are preferably dual mounted so that one pump and motor will be on standby. The typical methanol tank is a 1000-gallon replaceable bulk bin. An explosion proof motor 112 drives methanol pump 110. The methanol is pumped into the flow line 111 (FIG. 2) after the aftercooler 77 and before the first cooling heat exchanger 78. The methanol is added at the operator's discretion based on whether the vapors contain water vapor (based on, for instance, a moisture analyzer test). The spent methanol, along with the condensed water, is removed automatically from the bottom of the three-phase separator 85 through line 21A by a Norriseal™ (Dover Resources Co., Houston, Tex.) or equivalent level control valve and motor valve.

Another feature of the present invention is that the tanks have the ability to vent off small amounts of nitrogen and some product in the tank through back-pressure regulators V144 and V145. These regulators are set at a lower pressure than the tank pressure safety release valve. As the liquids in the tanks warm up, the vapor pressure increases up to the set point of the regulator. The vapors leave the tanks and flow through lines 142 and 141 into the line 148. Line 148 flows to the detonation arrestor 65A that protects the tanks from flame back from in line 148. This system eliminates flow of vapors to the flare except in upset conditions.

Pressure control valve V20A (FIG. 2) is adjusted to limit the downstream pressure of high pressure products like propane initially in vessel 91 that can reach 250 PSIG. Valve V20 is manually opened to allow flow to the bypass line 13. These higher-pressure vapors then flow to separator 72 and on to the heat exchangers. When the pressure falls to an operator-selected point, typically below 50 PSIG, the valve V20 is closed and normal 2-stage compressor operation is commenced.

The typical control panel provides the following systems:

1. An alarm and shutdown safety system as prescribed by the Coast Guard
2. A locally mounted pressure and temperature gauge system
3. A manual selection for lubricant delivery rate to the compressors
4. A "first out" annunciation system showing the status of operating or tripped safeties
5. A programmable logic controller to automatically control the compressor system
6. Other controls as needed and known in the art for such a system FIG. 1 illustrates the present invention itself (skid layout) and the piping connections to typical existing piping. Details of the piping and component configuration have already been discussed. The additional valves shown in FIG. 1 outside of the skid boundary of FIG. 2 are the minimum valves necessary to connect the present invention to the vapor disposal system described above.

The connections between the apparatus of the present invention and typical existing piping are illustrated by referring to valve V4, which is opened and valve V7 is opened on the skid S to flow the liquid nitrogen to the heat exchanger 83. Valve V8 is open on the skid and valve V6 is opened to allow all of the nitrogen to return after chilling exchangers 83 and 78 and to flow toward the evaporator. Valve TCV1 is a temperature control valve that enables the temperature of line 21 going to the cold separator 85 on the skid to be temperature controlled at −50° F. or even colder depending on the purity of nitrogen to be recycled. Valve V5 is closed to force all the nitrogen to flow through valves V4, V7, V8, and V6.

Valve V16 (FIG. 1) going to flare 94 is closed to force the vapors leaving the barge vessel 91 to enter the present invention when valve V15 to the skid is opened. The vapors then flow through the detonation arrestor 65C before entering the plant at pressure control valve V15. Valve V10 is a pressure control valve that maintains a down stream pressure from a set point. Valve V14 is an identical valve that is preferably set at approximately 15–20 PSIG higher for its set point than valve V10. This automatic pressure control system allows the nitrogen recycle gas to be returned through valve V14 as it is generated in increasing volumes during the complete purge cycle of the vessel 91 This time to de-pressure can take between 3 and 10 hours or more per vessel, depending on the product and the capacity of the vessel.

In the liquid filling mode, the vapor being displaced from vessel 91 and the pad gas (inert gas added to maintain pressure in vessel 91 during the earlier event of liquid removing) that might be present are processed by being pulled into inlet line at the plant inlet so as to recover a multitude of products and the pad gas. Since there is not a continuous flow of inert gas from tank 90 as during de-pressuring from which to extract a large refrigeration load, the recovery rates may be less. The product can be returned to the vessel 91 being filled (common practice of vapor balancing) or stored in tank 61 or other tank. The pad gas can be stored in another tank 62 or used later for its intended purpose. The actual recovery rates are primarily a function of the vapor being displaced, the flow rate of filling, the amount of inert gas present and the type of inert gas used as a pad gas. The economics of the particular application determine whether additional compression and or additional heat exchangers are also needed.

In the liquid removing mode, the common practice is to release the pressurized pad gas from the dedicated pad gas storage tank 61 or 62 through the appropriate valves and piping to return the pad gas to the vessel 91 being unloaded. Vessel 91 may have different pressure ratings, and in a common practice, a pressure control system is installed to prevent over- or under-pressurizing the vessel 91. The addition of pad gas is a normal practice and prevents pulling a vacuum on the vessel 91 and also increases the efficiency of the pump used for removing liquid from vessel 91 by increasing the head pressure in vessel 91 within limits of the suitable pressure rating of vessel 91.

Those skilled in the art who have the benefit of this disclosure will recognize that the embodiment of the present invention shown in the figures is a closed system. In keeping with the closed design of the system, rather than relief valves, the tanks 61 and 62 in which recovered product is collected are provided with pressure regulators V144 and V145 that are set at a lower pressure than a relief valve so that when the tanks 61 and 62 heat up, off gas escapes through the valves and into the line 148. Line 148 connects back to the input line inlet at junction 113 to valve V15 so that the vapors are recycled and not released to the atmosphere. For safety reasons, the closed system is provided with an opening at the pressure is relief valve V16 (FIG. 1), which routes gases to the flare 94 through a water seal 92 and detonation arrestor 96, all as known in the art.

Although described with relation to the preferred embodiments shown in the figures, those skilled in the art will recognize from this disclosure that a number of changes can be made in the manner in which the component parts of the vapor recovery systems of the present invention can be re-arranged without changing that manner in which those parts function to achieve their intended result. All such changes, and others which will no doubt be made clear to those skilled in the art by this description of the preferred embodiment, are intended to fall within the scope of the following non-limiting claims.

What is claimed is:

1. In the processing of vapor from the ullage of a an enclosed vessel with an inert expandable gas, a method of recovering vapor and the inert gas comprising the steps of:

(a) removing vapor from the ullage of an enclosed vessel;

(b) decreasing the temperature of the vapor to a temperature at which the liquids in the vapor condense by passing the vapor through a heat exchanger cooled by the inert expandable gas;

(c) separating the condensed liquids from the cold stream of vapor; and (d) utilizing the stream of cold vapor from which the condensed liquids have been separated in step (c) to decrease the temperature of the vapor between steps (a) and (b).

2. The method of claim 1 wherein the cold liquids separated in step (c) are also utilized to decrease the temperature of the vapor between steps (a) and (b).

3. The method of claim 1 wherein the flow of inert expandable gas through the heat exchanger in step (b) is varied to control the temperature of the cold stream of vapor.

4. The method of claim 1 wherein the vapor from the ullage of the vessel is displaced with the inert expandable gas.

5. The method of claim 4 wherein the inert expandable gas exiting the heat exchanger in step (b) is mixed with the inert expandable gas used to displace vapor from the ullage of the vessel.

6. The method of claim 5 wherein the cold vapor from which condensed liquids are separated is mixed with the inert expandable gas used to displace vapor from the ullage of the vessel.

7. The method of claim 1 wherein vapor removed from the ullage of the vessel is compressed before the cold vapor from which condensed liquid has been separated is used to decrease the temperature of the vapor in step (d).

8. The method of claim 7 wherein the amount of lubricant pumped into the compressor is selected from a pre-set range of lubricant volumes depending upon the nature of the vapor removed from the vessel.

9. The method of claim 7 additionally comprising condensing product vapors from the compressed vapor at ambient temperature.

10. The method of claim 9 wherein the compressed vapor is compressed a second time after condensing product vapors therefrom.

11. The method of claim 10 wherein the lubricant volume pumped into the second compressor is selected by selecting the lubricant volume pumped into the first compressor and the second compressor.

12. The method of claim 9 additionally comprising mixing the condensed product vapors with the cold stream of vapor exiting the heat exchanger between steps (b) and (c).

13. The method of claim 1 wherein the flow of inert gas is decreased as the amount of recycled warm inert gas increases.

14. The method of claim 1 wherein the refrigeration is varied as needed to continue to make purity separation of product from the inert gas as inert gas concentration increases.

15. Apparatus for recovering vapor from the ullage of a vessel during de-pressuring, loading, or unloading operations utilizing an inert gas comprising:

a compressor for receiving vapor from the ullage of a vessel, the vapor comprising product vapor and an inert cryogenic gas;

a first separator for separating the output from said compressor into liquids for recycling and gases;

a heat exchanger for reducing the temperature of the gases output from said separator, the reduction in temperature being effected by expansion of said inert gas before said inert gas is used to purge the ullage of the vessel;

a temperature control valve for controlling the expansion of inert gas entering said heat exchanger; and a second separator for separating condensed liquids from the reduced temperature gases for recycling, the remaining reduced temperature gases being returned to the inert gas for use in purging the ullage of the vessel.

* * * * *